United States Patent [19]

Ouchi

[11] Patent Number: 4,665,384

[45] Date of Patent: May 12, 1987

[54] SIGNAL-TRANSMITTING JUNCTION UNIT OF HAZARD ALARM SYSTEM

[75] Inventor: Hiroshi Ouchi, Tokyo, Japan

[73] Assignee: Nittan Company, Limited, Japan

[21] Appl. No.: 774,309

[22] Filed: Sep. 10, 1985

[30] Foreign Application Priority Data

Sep. 14, 1984 [JP] Japan ..... 59-191742

[51] Int. Cl.[4] ..... G08B 1/08

[52] U.S. Cl. ..... 340/534; 340/531; 340/505; 340/510; 340/511

[58] Field of Search ..... 340/534, 537, 531, 500, 340/506, 505, 508, 510, 511, 825.06, 825.08, 825.54

[56] References Cited

U.S. PATENT DOCUMENTS 4,249,166 2/1981 Schultz ..... 340/505
4,392,125 7/1983 Iwata ..... 340/505
4,394,655 7/1983 Wynne et al. ..... 340/505
4,468,664 8/1984 Galvin et al. ..... 340/505

*Primary Examiner*—Donnie L. Crosland
*Attorney, Agent, or Firm*—Webb, Burden, Robinson & Webb

[57] ABSTRACT

A signal transmitting junction unit for a hazard alarm system includes a signal transmission control unit, a zone line circuit connected to an electric source and having at least one hazard sensor connected thereto and an analog digital convertor; and the zone line circuit outputs the source voltage when a sensor connected to the zone line detects a hazard, outputs a voltage between the source voltage and the zero voltage when the sensor is under the normal monitoring standby condition, and outputs no voltage when the sensor is out of order upon calling from the central control unit and the voltage is digitized by the analog-digital converter and sent back to the central control unit through the transmission control unit.

2 Claims, 1 Drawing Figure

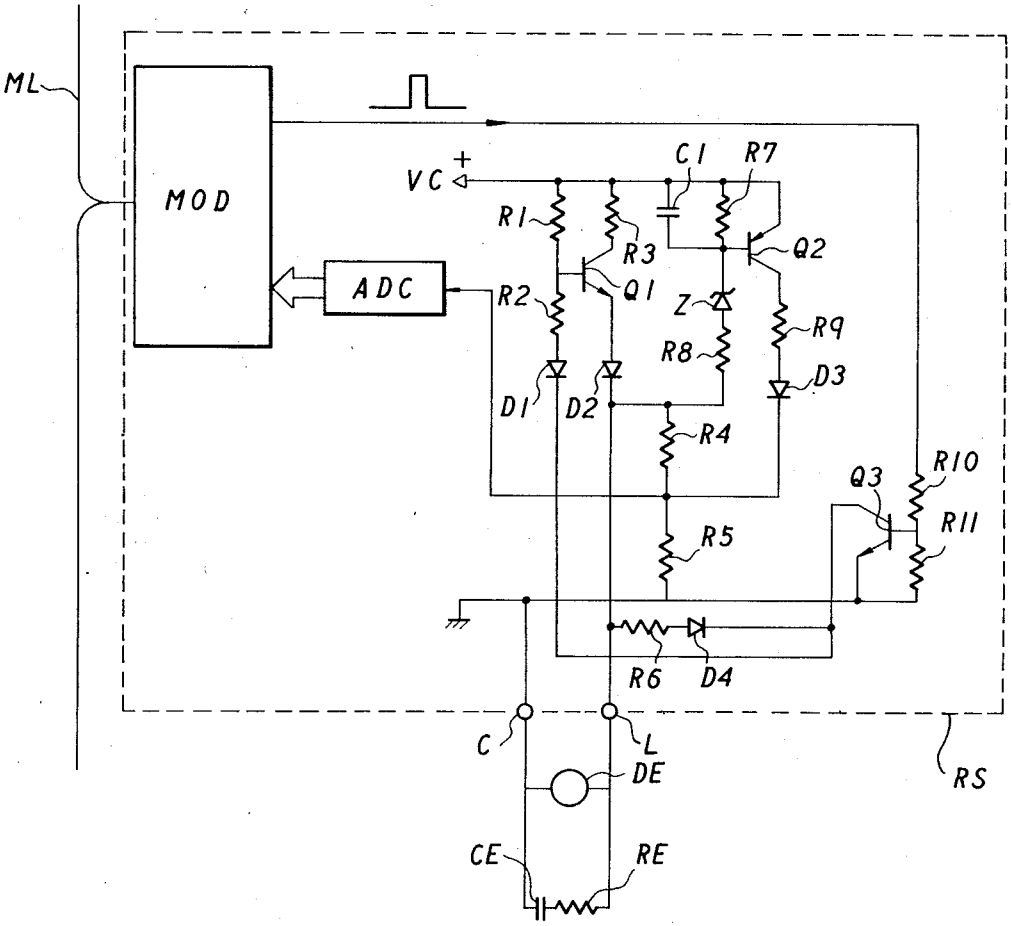
RS
R10
R11
Q3
R9
D3
Q2
R7
C1
Z
R8
R4
R5
D4
R6
R3
Q1
D2
R1
R2
D1
VC
+
ADC
MOD
L
DE
RE
C
CE
ML

SIGNAL-TRANSMITTING JUNCTION UNIT OF HAZARD ALARM SYSTEM

FIELD OF THE INVENTION

This invention generally relates to a hazard alarm system which detects fires, gas leaks, intruders or the like. More particularly, this invention relates to a signal-transmitting junction unit of such a hazard alarm system, which receives a signal from at least one sensor connected to said junction unit and placed in a section in a building, for instance, and sends the signal to a central control unit placed in a custodian's room, for instance, through such a signal-transmitting junction unit in response to the calling from said central control unit by polling or some other means.

BACKGROUND OF THE INVENTION

There has been known a hazard alarm system which comprises a central control unit and a plurality of alarm signal transmitting junction units connected to the former, from each of which extends one zone line having at least one sensor (heat sensor, smoke sensor, or the like) connected thereto and located at a place where any hazard must be monitored, wherein the central control unit calls the signal transmitting junction units in turn by polling, for instance requesting send-back of the signal from the sensor connected to the junction unit which has been called, and the central control unit judges the situation—normal situation, disorder of the device, or occurrence of a hazard such as fire, gas leak, etc. from the received signal and generates an alarm in accordance with the situation.

The signal-transmitting junction unit of such a hazard alarm system generally requires a priority determination circuit, encoder, etc. to produce signals to be sent to the central control unit. Also when the detection of disorder such as break of line is conducted intermittently, the junction unit effects the detection when it is called, or otherwise it has to memorize the detected results until it is called next time. Therefore, the circuit structure thereof is inevitably very complicated. A signal transmitting junction unit of a simple structure is not known until today.

DISCLOSURE OF THE INVENTION

This invention provides a signal-transmitting junction unit for a hazard alarm system which connects a central control unit and a pair of zone lines provided with at least one hazard sensor means connected thereto, and transmits signals representing the conditions of the zone lines when it is called by the central control unit, said signal-transmitting junction unit comprising a signal transmission control unit which receives and transmits signals from and to the central control unit and outputs a pulse to a zone line circuit mentioned hereinafter when it receives a code signal allotted threreto; a zone line circuit which is connected to an electric source on one side and to said zone lines on the other side, and outputs a different voltage in accordance with the signal from the sensor means which represents occurrence of a hazard, a normal monitoring standby state or disorder in the zone line; and an analog-digital converter which receives the signal voltage from the zone line, converts it into a digital signal and outputs it to the signal transmission control unit to be sent back to the central control unit.

The apparatus of this invention can be constructed by those skilled in the art who read the following description, and necessary or desirable modifications can be effected within the scope of the appended claims.

The invention will now be described in detail with reference to the attached drawing.

BRIEF DESCRIPTION OF THE DRAWING

The sole drawing is a circuit chart of an embodiment of the signal-transmitting junction unit for a hazard alarm system of this invention.

SPECIFIC DESCRIPTION OF THE INVENTION

The signal-transmitting junction unit RS of this invention is connected to a central control unit (not shown) via a main line ML. It should be noted that a plurality of signal-transmitting junction units are connected to said main line ML. The signal-transmitting junction unit RS is constructed as follows.

A resistor R1, another resistor R2 and a diode D1 connect an electric source VC and the collector of a transistor Q3. The junction of the resistors R1 and R2 is connected to the base of a transistor Q1. A resistor R3, the collector and emitter of the transistor Q1 and a diode D2 connect the source VC and a terminal L of the signal-transmitting junction unit, which is connected to the collector of the transistor Q3 via a discharge circuit consisting of a resistor R6 and diode D4. A capacitor C1 and a resistor R7 connected in parallel connect the source VC to the base of a transistor Q2, and the base of the transistor Q2 is grounded through a serial circuit of a Zener diode Z and a resistor R8 and a voltage-dividing circuit consisting of resistors R4 and R5 connected in series. The source VC is connected to the junction of the resistors R4 and R5 through the emitter and collector of the transistor Q2, a resistor R9 and a diode D3. The junction of the resistors R4 and R5 is connected to the input terminal of an analog-digital converter ADC. The output terminal of the analog-digital converter ADC is connected to the input terminal of a transmission control unit MOD. An output terminal of the transmission control unit MOD is grounded through resistors R10 and R11 connected in series together with the emitter of the transistor Q3. The base of the transistor Q3 is connected to the junction of the resistors R10 and R11. Another terminal of the signal transmitting junction unit is grounded.

To the terminal C and L are connected a pair of zone lines, to which at least one sensor DE is connected, and a capacitor CE and a resistor RE are connected at the end of the sensor lines.

The central control unit can be of any type known among those skilled in the art.

The transmission control unit MOD is a commercially available serial transmission IC chip. One of ED series (ED-5, 9, 11, 15 etc.) manufactured by Supertex, Inc. can be used. We used EWD-106 marketed by Fuji Electric Co. Ltd (Fuji Denki Seizo K. K.), which contains an analog-digital converter incorporated therein.

In the following description, the circuit part as illustrated in the sole drawing from which the signal transmission control unit MOD and the analog-digital converter ADC are excepted is called "zone line circuit" for the sake of convenience. However, it should be distinguished from "zone line" per se.

The thus constructed signal-transmitting junction unit works as follows. Normally, the transistor Q1 in the zone line circuit is in the ON state, since voltage is applied to the base thereof through the resistor R1. Thus electric current is supplied to the terminal L through the resistor R3, transistor Q1 and the diode D2. The sensor DE is in the high impedance state under the monitoring condition and thus almost the source voltage VC is applied between the terminals L and C. In this state, there exists no base current in the transistor Q2 and therefore it is in the OFF state. At the junction of the resistor R4 and the resistor R5 a divided value of the source voltage VC is supplied as an taken out and is input to the analog-digital converter ADC. If a sensor DE operates, the pair of zone lines are made conductive and thus the terminal L and C are almost short-circuited. Then electric current flows through the emitter and base of the transistor Q2, the Zener diode Z and the resistor R8 and thus the transistor Q2, becomes ON state. The resistance of the resistor R9 is selected to be of lower impedance in comparison with the resistors R4 and R5, and therefore almost the source voltage VC is applied to the analog-digital converter ADC through the transister Q2, the resistor R9 and the diode D3.

When the transmission control unit MOD is called by the central control unit, if the addressing code coincides with the code alloted to the junction unit, the transmission control unit outputs a pulse. The pulse is applied to the base of the transistor Q3 through the resistor R10 temporarily turning the transistor ON. Thus the base current of the transistor Q1 is drained through the resistor R2 and the diode D1. Therefore, voltage supply to the terminal L is suspended, the resistor R6 and the diode D4 works as a discharge circuit.

At the end of the zone lines, a terminal unit consisting of a capacitor CE and a resistor RE is connected. The values of these elements are selected so that the voltage across the terminals L and C substantially does not drop in comparison with the normal state by the voltage accumulated in the capacitor CE of the terminal unit when the sensor DE does not operate and the zone lines are in the normal condition. Therefore, the input voltage to the analog-digital converter ADC remains normal, that is, the divided value of the source voltage VC is input.

If the zone lines are out of order, the voltage across the terminals L and C temporarily drops to zero, but the transistor Q2 does not turn ON owing to the effect of the time constant circuit composed of the resistor R8, capacitor C1, etc. Thus the voltage to be input to the analog-digital converter ADC drops to zero. Incidentally, the above-mentioned discharge circuit consisting of the resistor R6, the diode D4 and the transistor Q3 is also intended to eliminate the influence of stray current in the zone lines.

As explained above, when the junction unit RS is called by the central control unit, the zone line circuit thereof outputs the divided value of the source voltage VC under the normal condition; outputs almost the source voltage VC when the sensor DE operates; and outputs almost no voltage when some part of the zone lines is out of order.

The analog-digital converter ADC, which may be of any type, converts analog signal from the zone lines to digital signals and supplies them to the transmission control unit MOD as information to be sent to the central control unit.

As described above, this invention provides a signal-transmitting junction unit suitable for a hazard alarm system utilizing tansmission means such as polling.

I claim:

1. A signal-transmitting junction unit for a hazard control system which connects a central control unit to a pair of zone lines having at least one hazard sensor connected thereto, said junction unit comprising a signal transmission control unit connected to a zone line circuit, an analog-digital connector which converts an output voltage generated by the zone line circuit and supplies a digital signal to the signal transmission control unit, said zone line circuit adapted to be connected to said pair of zone lines, with the signal transmission control unit adapted to receive and transmit signals from and to the central unit and to supply an output pulse to the zone line circuit when it receives a code signal allotted thereto, said zone line circuit including a source voltage, means for applying said source voltage to said zone lines to place the zone lines in a monitoring standby state, switch means for activating said zone line circuit in response to said output from said signal transmission control unit, voltage dividing circuit means for producing an output signal which is a predetermined percentage of said source voltage when a sensor connected thereto detects a normal condition, means for short circuiting said zone lines and producing an output signal which is about the source voltage when a sensor connected thereto detects an abnormal condition, and means for preventing discharge of a voltage in the zone lines and producing an output signal which is about zero when the zone lines are malfunctioning.

2. The signal transmitting junction unit for a hazard alarm system as recited in claim 1 wherein the zone line circuit is provided with a means which drains source voltage applied to the terminal of the zone line when it receives the code pulse from the signal transmission control unit.

* * * * *